US007636953B2

(12) United States Patent
Grey

(10) Patent No.: US 7,636,953 B2
(45) Date of Patent: Dec. 29, 2009

(54) HAIR WRAP WITH DIFFERENT SIDEDNESS

(76) Inventor: Gary Grey, c/o Spartan Brands Incorporated, 220 E. 23rd St., Suite 601, New York, NY (US) 10010

( * ) Notice: Subject to any disclaimer, the term of this patent is extended or adjusted under 35 U.S.C. 154(b) by 145 days.

(21) Appl. No.: 11/809,848

(22) Filed: Jun. 1, 2007

(65) Prior Publication Data

US 2008/0295221 A1 Dec. 4, 2008

(51) Int. Cl.
*A42B 5/00* (2006.01)

(52) U.S. Cl. ..... 2/207; 2/174

(58) Field of Classification Search ..... 2/204, 2/207, 200.2, 171; 132/212, 162, 222, 274; D28/10
See application file for complete search history.

(56) References Cited

U.S. PATENT DOCUMENTS 1,327,062 A * 1/1920 Quinn ..... 2/1
1,554,163 A * 9/1925 Lipper ..... 66/171
2,005,361 A * 6/1935 de Wolf Rollins et al. .... 2/195.1
2,600,814 A * 6/1952 Tomarkin ..... 2/207
2,824,311 A * 2/1958 Barnett ..... 2/207
2,883,670 A * 4/1959 Pratt ..... 2/207
3,105,970 A * 10/1963 Herzberg ..... 2/91
3,327,720 A * 6/1967 Carmony et al. ..... 132/274
3,351,073 A * 11/1967 Gregg ..... 2/209.3
3,522,813 A * 8/1970 Corey ..... 132/274
3,561,455 A * 2/1971 Gregg ..... 132/274
3,587,114 A * 6/1971 McCourtie ..... 2/67
3,618,140 A * 11/1971 Goldfarb ..... 2/207
3,746,015 A * 7/1973 Schulman ..... 132/212
4,138,744 A * 2/1979 Pitzel ..... 2/209.11
4,491,985 A * 1/1985 Dalton ..... 2/172
5,253,369 A * 10/1993 Patterson, Jr. ..... 2/207
5,265,278 A * 11/1993 Watanabe ..... 2/174
6,032,292 A * 3/2000 Wood et al. ..... 2/207
6,247,181 B1 * 6/2001 Hirsch et al. ..... 2/207
7,159,248 B1 * 1/2007 Saintlot ..... 2/206
2005/0097655 A1 * 5/2005 Bascom ..... 2/171
2006/0005297 A1 * 1/2006 Blecha ..... 2/207
2006/0041993 A1 * 3/2006 Elea ..... 2/422
2006/0085891 A1 * 4/2006 Larkin et al. ..... 2/171
2008/0235851 A1 * 10/2008 Grey ..... 2/174

* cited by examiner

*Primary Examiner*—Katherine Moran
*Assistant Examiner*—Richale L Quinn
(74) *Attorney, Agent, or Firm*—Ostrolenk Faber LLP

(57) ABSTRACT

A head wrap or scarf assembled from two parts joined on a seam line. Each of the parts is a single layer thick with more slippery fibers on one side and less slippery fibers on the other side. The parts are joined with the more slippery side of one part and the rougher side of the other part facing toward each side of the scarf so that when the scarf is folded, one outward facing surface is slippery and the outward facing surface is rougher.

7 Claims, 1 Drawing Sheet

HAIR WRAP WITH DIFFERENT SIDEDNESS

BACKGROUND OF THE INVENTION

The present invention relates to a fabric head wrap or hair covering particularly useful to be worn when the head rests against another surface, such as a pillow during sleep. The wrap has two different surface characteristics on opposite sides of the fabric and maintain that two sideness when folded.

While sleeping, a person who has a hairstyle that she wishes to preserve would prefer that her hair not rub on a pillow or surface on which she is lying, as that may mess the hairstyle. To prevent that, a hair wrap or covering such as a bonnet, scarf or other wrap, is applied on or wrapped around the head to hold the hairstyle in place. However, when the head with the hair wrap lies on a pillow, especially during sleep when the head moves periodically, the fabric of the head wrap will drag on the fabric of the pillow and possibly cause the head wrap to slide over or off the hair, disturbing the hairstyle beneath the wrap.

An additional problem experienced particularly by many women of African descent is that their hair breaks easily. Much hair breakage among such women occurs during the night due to rubbing and friction between the hair and the pillow. Additionally, their hair is difficult to manage and to style. As a result, many women of African descent sleep wearing a fabric head wrap.

Head wraps are formed in various shapes and styles including a bonnet, a cap, a scarf, a smaller size wrap covering less than the entire head, etc. The wrap disclosed herein is intended to be folded prior to being placed on the head.

The art has attempted to avoid the problem of friction between the hair and a pillow or other surface by providing a wrap for the head wherein the outward, typically pillow contacting, surface of the wrap is of a fabric or material that is more likely to slide over the surface of the pillow or surface rather than to be restrained by it. Satin is used for many head wraps because it is slippery and reduces friction and rubbing against a pillow. A satin head wrap is also slippery on the inside against the hair. That can cause a problem for a wearer during sleep because the slippery interior of the wrap tends to slide off the hair during the night. For this reason, many wearers of head wraps avoid use of satin wraps.

To solve this problem, some prior art shows two layer head coverings, including a first slippery layer on the outside that rests against the pillow and a less slippery or rougher second layer on the inside that contacts the hair with sufficient friction that the head wrap will not slide off the hair. An example of this is in U.S. Pat. No. 3,561,455.

Kerchiefs and scarves in particular are generally produced as squares or rectangles, but other shapes are known too. For comfort and to provide tieable ends, a typically square shape kerchief or scarf is folded double, typically on a diagonal extending between two opposite corners. If a hair wrap or scarf has different slipperiness on its opposite sides, when the wrap or scarf is folded, one surface on the inside of the fold is covered, so that the two outside surfaces of the folded wrap or scarf are both slippery or both rough. That defeats the purpose of providing two sidedness of a single unfolded layer.

SUMMARY OF THE INVENTION

No head wraps, scarves or kerchiefs known to the Applicant have comprised a single layer head wrap that has both a slippery external surface characteristic and a rougher internal surface characteristic in a single layer of material. Applicant has disclosed in U.S. application Ser. No. 11/805,209, filed May 22, 2007, that a single layer head wrap is desirable because it is easy to handle, there will be no apparent slippage between two separate layers and a single layer can be made thin, so that the head wrap is easily folded, or otherwise formed to the head and is very flexible.

The invention concerns a head wrap, and particularly a scarf or kerchief, that is assembled from two initially separate, single layer parts of flexible fabric or material. Each part is triangular in shape. Each part includes a first, more slippery side and an opposite, second, rougher surface side. The two parts are joined along a joinder line or seam. The parts are oriented with respect to each other so that at one side of the complete kerchief or scarf, one part has the slippery side facing out and the other part has the rougher side facing out, and at the second, reverse side of the kerchief or scarf, the same condition is present. If the kerchief or scarf is folded along the joinder between the parts, the resulting folded scarf or kerchief has a rougher side and a more slippery side, where the rougher side is the rougher side of one of the parts and the slippery side is a side of the other part.

Preferably, the scarf or kerchief is initially rectilinear, e.g., a rectangular and preferably square. The joinder line between neighboring edges of the two parts is preferably seamed. The joinder extends across the kerchief or scarf, preferably between two opposite corners and preferably on a diagonal.

The single layer of each part of the head wrap may be made of a knitted material that is knitted from two types of yarn. The yarn at the one side or surface of the part is predominantly and has a greater proportion of a slippery satin-like material and the yarn at the other side or surface of the part is predominantly and has a greater proportion of preferably a rougher or a textured material. Thus, in a single knitting process, both a slippery outside and rough inside of a single layer head wrap are produced. This process produces a single layer with the benefit of the slippery aspect of a satin-like fabric on one side and a soft, cushioned and/or textured other side that holds on the hair and prevents the head wrap from sliding over the hair during sleep. This combination is intended to avoid messing of the hairstyle.

Each part of the head wrap is of one layer material with two distinct, different sides, rather than being two overlying pieces of materials joined or laminated together. A single layer or piece of material is preferred over two joined layers because the single layer is light, easily moldable, easily tieable, as a head wrap should be comfortable, and the single layer "breathes", allowing moisture of perspiration, etc. out and air in.

DESCRIPTION OF PREFERRED EMBODIMENTS

Figure 1:
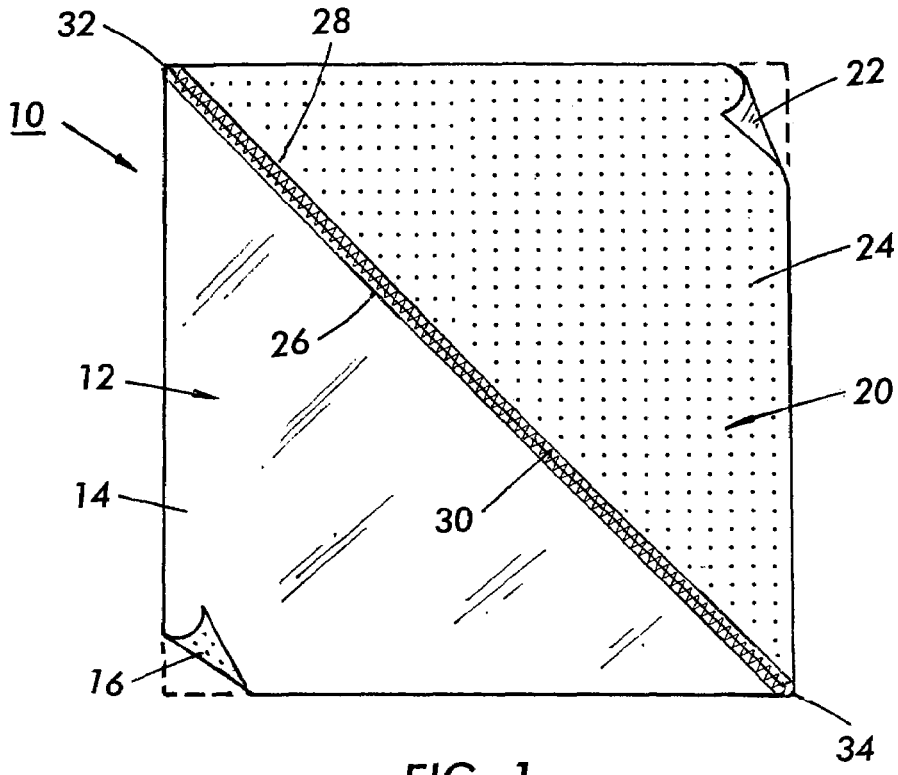
FIG. 1 is a plan view of a head covering, kerchief or scarf according to an embodiment of the invention.

The head wrap, and more particularly the head scarf 10 in the drawings, is a single layer of fabric comprised of two parts 12 and 20 secured together. Each of the parts may be identical, and the parts are joined.

In particular, the scarf 10 has a first triangular shaped part 12 which is comprised of a single layer of fabric having opposite first and second sides or surfaces 14 and 16 with a respective different sidedness characteristic. The first side 14 has a slippery, satin-like characteristic. The opposite second side 16 has a rougher characteristic. It is intended that a user would wear the scarf such that the rougher material side 16 would be worn against the hair and the slippery material side 14 would face outwardly and might contact a pillow or another surface and slide over it rather than being snagged on it. The scarf is intended to stay in place and not be pulled off by the friction between the rougher side of the scarf and the surface against which the scarf is rested.

The second triangular shaped part 20 of the scarf 12 may be identical to the first part 12 including the triangular shape and dimensions and two-sidedness. The dimensions and specific fabrics of the two parts 12 and 20 need not be identical. But, for symmetry and neatness in appearance, identity is preferred. The second part 20 includes the slippery, satin-like side 22, which is on the underside in FIG. 1, and the rougher top side 24. In part 12, the rougher side 16 is facing downwardly in FIG. 1 and in part 20, the rougher side 24 is facing upwardly. The scarf 10 is formed of two parts, 12 and 20, each having its two sidedness, with the slippery side of one part and the rougher side of the other part facing in the same direction.

The two part 12 and 20 of the scarf 10 are attached or joined to each other, e.g., by their neighboring joining edges 26, 28 being sewn or seamed together at seam 30, which extends along a diagonal between the corners 32 and 34 of the scarf 10. The separation between the parts and a joinder or seam between them need not only be at a diagonal, but may extend between two lateral sides of the scarf or be at any other orientation which divides the scarf into two parts having the slippery or roughness characteristics, such as 12 and 20.

The seam 30 and the different surface textures of the parts 12 and 20 at opposite sides of the seam suggests to the user that the scarf should be folded along the diagonal 30.

Figure 2:
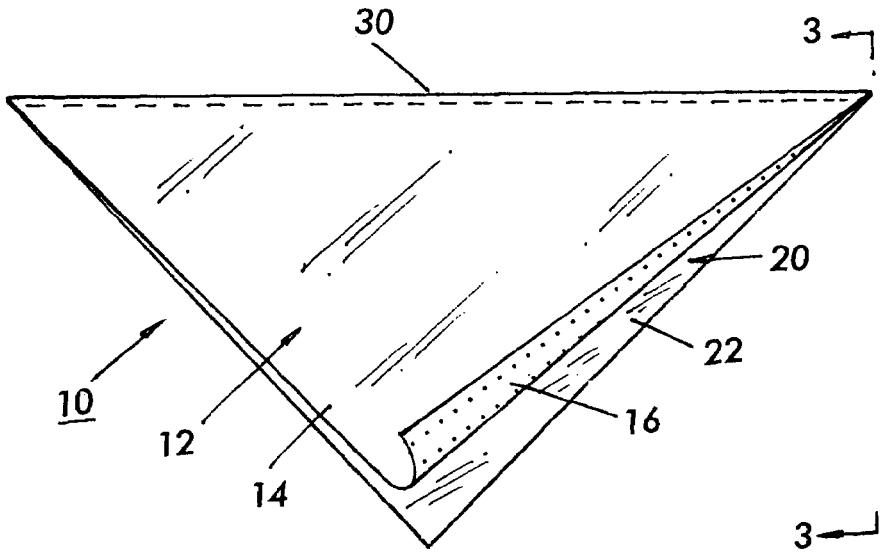
FIG. 2 shows the same covering or scarf folded in half along a diagonal.
Figure 3:
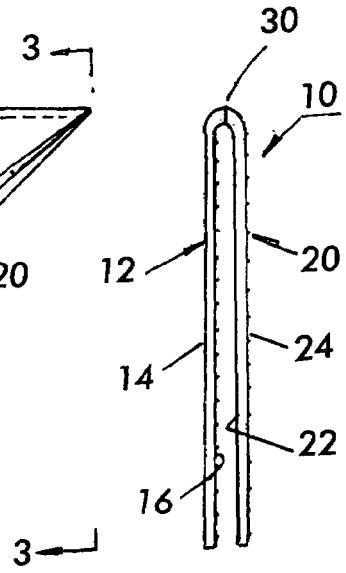
FIG. 3 is an edge view of the folded covering or scarf in FIG. 2.

As shown in FIGS. 2 and 3, when the scarf 10 is folded, whether folded in one direction or the other around the seam 30, one outward surface of the now triangular shaped folded scarf is the outward facing slippery surface 14 of the first part 12 and the opposite outward surface of the folded scarf is the outward facing rougher surface 24 of the second part 20. Thus, with the scarf folded in a triangle which is a normal way of folding a scarf for wear, the user obtains the benefit of a rougher surface 24 of the part 20, which may be placed against the wearer's hair, and the slippery surface 14 of the part 12 which faces outwardly and may slide over a pillow surface.

One suggested material for the single fabric layer of both parts 12 and 20 of the scarf is made using a 28 gauge 30 inch diameter circular double knit knitting machine. 50 denier 36 filament bright polyester yarn is used in the knitting to be predominant on the outer face of the fabric to make that surface relatively slippery against another fabric, e.g., on a pillow, and 50 denier 36 filament textured polyester yarn is used in the knitting to be predominant on the back or head side of the fabric wrap to make that surface relatively rougher against a wearer's hair. The machine is set to knit 40 stitches per inch. A known double knit machine may be used to knit the scarf or head wrap.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A head wrap or scarf comprising:

a first scarf part including a first joining edge;

a second scarf part including a second joining edge attached to the first joining edge; and each of the first scarf part and the second scarf part comprising a single layer comprising one fabric with a first surface that is slippery against another surface and a second surface that is rougher and less slippery than the first surface, the first surface facing in an opposite direction than the second surface, wherein the first scarf part is attached at the first joining edge to the second joining edge of the second scarf part such that the first surface of the first scarf part adjoins and faces the same direction as the second surface of the second scarf part, and the second surface of the second scarf part adjoins and faces the same direction as the first surface of the second scarf part.

2. The head wrap or scarf of claim 1, wherein the single layer of each of the first scarf part and the second scarf part is comprised of two fibers, a first fiber of the two fibers having the slipperiness and roughness different from the second fiber of the two fibers, with the greater proportion of slippery fibers positioned toward the first surface of the respective part and a greater proportion of rougher and less slippery fibers positioned toward the second surface of the respective part.

3. The head wrap or scarf of claim 1, wherein when the head wrap or scarf is folded along the first joining edge and the second joining edge, an entire major outwardly facing surface of the folded head wrap or scarf includes only the first surface and another entire major outwardly facing surface of the folded head wrap or scarf includes only the second surface.

4. The head wrap or scarf of claim 1, wherein each of the first and second parts of the head wrap or scarf is triangular in shape and a side of each of the first and second parts is the joining edge.

5. The head wrap or scarf of claim 4, wherein the scarf is square in shape.

6. The head wrap or scarf of claim 1, wherein the head wrap or scarf has diagonally opposite corners and the first joining edge and the second joining edge extend between the opposite corners.

7. A head wrap or scarf comprising:

a first scarf part including a first joining edge;

a second scarf part including a second joining edge attached to the first joining edge; and each of the first scarf part and second scarf part comprises a fabric with a first surface that is slippery against another surface and a second surface that is rougher and less slippery than the first surface, the first surface facing in an opposite direction than the second surface, wherein the first scarf part is attached at the first joining edge to the second scarf part such that the first surface of the first scarf part adjoins and faces the same direction as the second surface of the second scarf part, and the second surface of the second scarf part adjoins and faces the same direction as the first surface of the second scarf part.

* * * * *